United States Patent [19]

Wrobel

[11] 4,262,835

[45] Apr. 21, 1981

[54] TAPE DISPENSER

[75] Inventor: Norbert E. Wrobel, New Scandia, Minn.

[73] Assignee: Minnesota Mining and Manufacturing Company, Saint Paul, Minn.

[21] Appl. No.: 115,898

[22] Filed: Jan. 28, 1980

[51] Int. Cl.[3] ..... B26F 3/02

[52] U.S. Cl. ..... 225/25; 225/15; 225/38; 225/47; 225/90

[58] Field of Search ..... 225/90, 46, 47, 38, 225/37, 15, 25

[56] References Cited

U.S. PATENT DOCUMENTS

| | | | |
|---|---|---|---|
| 2,484,673 | 10/1949 | Becker | 225/38 X |
| 2,678,777 | 5/1954 | Donkin | 225/25 X |
| 2,709,049 | 5/1955 | Weis | 225/25 |
| 3,034,691 | 5/1962 | Gershen | 225/25 |
| 3,502,252 | 3/1970 | Mariani | 225/38 X |

*Primary Examiner*—Frank T. Yost

*Attorney, Agent, or Firm*—Cruzan Alexander; Donald M. Sell; Terryl K. Qualey

[57] ABSTRACT

A multiple tape dispenser for wire marker tape consisting of a plurality of identical tape dispensers secured together coaxially. Each tape dispenser is generally cylindrical and has an arcuate hinged door which in its closed position forms part of the circumferential edge wall of the housing. Tape wound on a core in the housing has its free end folded back over an arcuate area beneath the free end of the arcuate door with the adhesive side of the tape adhering to the underside of the door such that when the door is opened the tape peels from the back side of the door and stands up for easy access by the user.

15 Claims, 6 Drawing Figures

TAPE DISPENSER

BACKGROUND OF THE INVENTION

The present invention relates to a tape dispenser particularly useful for dispensing wire making tapes.

Electrical wire identification marking requires the ten digits to be separately supplied so that they can then be applied in any sequence by the user. Most frequently the digits are imprinted on pressure sensitive adhesive tapes supplied on cards or sheets or in roll form. The prior art roll tape dispensers have been unduly large because of the necessity of providing a space between the roll and the cutting edge against which the tape is severed where the tape can be pinched between two fingers to be pulled out. Multiple roll tape dispensers are disclosed in U.S. Pat. Nos. 593,035; 2,470,250; 2,250,774; 2,610,000; 2,710,152; 3,502,252; and 3,547,327. The last two of these patents are most representative of the size problem, both in length and diameter, created by the need for making the end of the marking tape accessible for pinching between the fingers of the user. Also, in those type of dispensers the tape, after being pinched between two fingers, must be pulled beyond the cutting edge for severing, resulting in greater than a finger width of tape being withdrawn which is often more than is necessary for wire marking.

SUMMARY OF THE INVENTION

The tape dispenser of the present invention has a generally cylindrical, hollow plastic housing including an arcuate door hinged across the width of the housing and in its closed position forming a part of the circumferential edge wall of the housing. The housing has an arcuate tape fold back area extending from the free end of the arcuate door in its closed position parallel to and immediately beneath a portion of the arcuate door. A tape cut-off blade extends across the width of the housing adjacent the free end of the arcuate door in its closed position. A tape core is supported for rotation within the housing and a strip of pressure sensitive adhesive tape is wound on the tape core, the tape being wound on the core such that when the arcuate door is closed the non-adhesive side of the free end thereof will fold over and contact the fold back area of the housing while the adhesive side thereof contacts and adheres to the underside of the portion of the arcuate door overlying the fold back area. The adhesion of the tape to the arcuate door and the tape pull-off force from the tape core is selected such that the tape will peel from the underside of the arcuate door as the arcuate door is opened beyond the tape fold back area.

Folding back of the end of the tape provides a short flag of tape which adheres to the back side of the door. When the door is opened and the tape peels from it, the short flag of tape stands up and is readily accessible directly at its free end. The user can then pull out and sever just the amount that he needs. This method of presenting the tape also permits the dispenser to be very compact.

THE DRAWING

Figure 1:
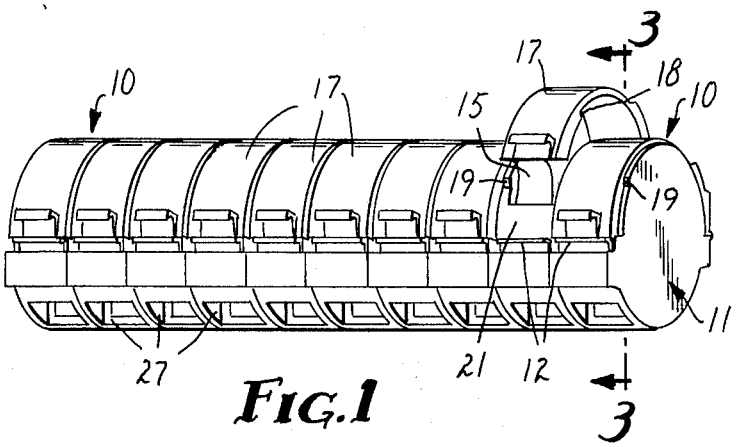
FIG. 1 is a perspective view of a multiple tape dispenser made in accordance with the present invention.
Figure 2:
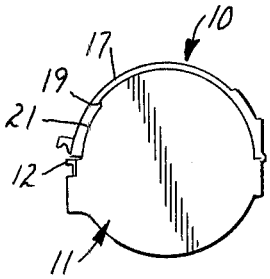
FIG. 2 is an end view of the multiple tape dispenser of FIG. 1.

The multiple tape dispenser illustrated comprises ten similar tape dispensers 10 coaxially secured together and similarly oriented on their common axis. Each tape dispenser comprises a generally cylindrical, hollow plastic housing 11, a tape cut-off blade 12, a tape core 14 and a strip of pressure sensitive adhesive tape 15.

The housing 11 includes an arcuate door 17 hinged across the width of the housing 11 and in its closed position forming a part of the circumferential edge wall of the housing. In the illustrated embodiment the door 17 forms nearly 180° of the circumferential edge wall of the housing. Shoulders 18 are formed at the edges of the arcuate door 17 near the free end thereof and complementary recesses 19 are formed in the end walls of the housing for latching the door in its closed position. In the illustrated embodiment the shoulders 18 extend across the width of the door to form a continuous shoulder creating a thicker section at the free end of the door than over the remainder of its length. The door 17 is molded with a slightly smaller radius of curvature and a slightly greater arc length than the complementary portions of the end walls of the housing 11 so that as the door is closed it resiliently flexes to increase its radius of curvature. When the shoulders 18 pass into the recesses 19 the radius of curvature of the door decreases slightly and the tension in the door tending to further decrease it holds the door closed.

The housing 11 is formed with an arcuate tape fold back area 21 extending from the free end of the arcuate door 17 in its closed position parallel to and immediately beneath a portion of the door for a purpose which will be hereinafter described.

The tape cut-off blade 12 extends across the width of the housing 11 adjacent the free end of the arcuate door 17 in its closed position. In the illustrated embodiment each of the dispensers 10 is formed individually and has its own cut-off blade 12 on the stationary part of the housing. The cut-off blade may, alternatively, be on the free end of the door. In the illustrated embodiment the dispensers are bonded together to form the multiple dispenser. The dispensers 10 may also be formed with mechanically mating parts, such as snap fasteners, for securing them together to make a multiple dispenser. Alternatively, the multiple dispenser housings 11 may be molded as a single piece and the cut-off blades 12 may be provided in a single strip along the entire length of the multiple dispenser.

Figure 5:
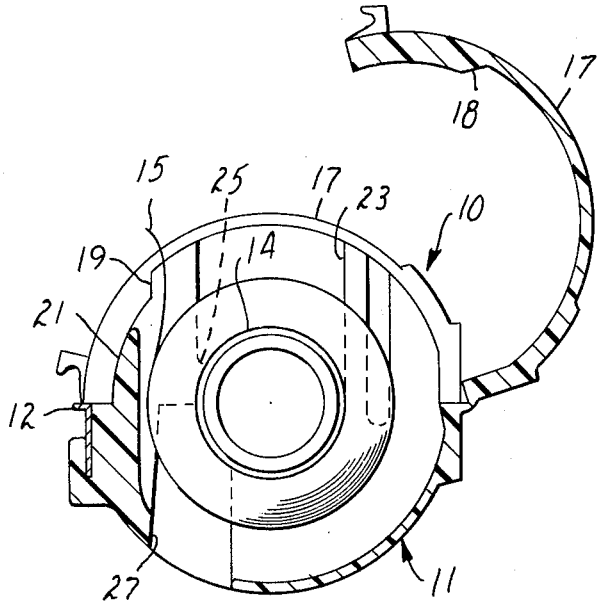
FIG. 5 is a view similar to those of FIGS. 3 and 4 with the door further opened and the tape end flagged up.
Figure 6:
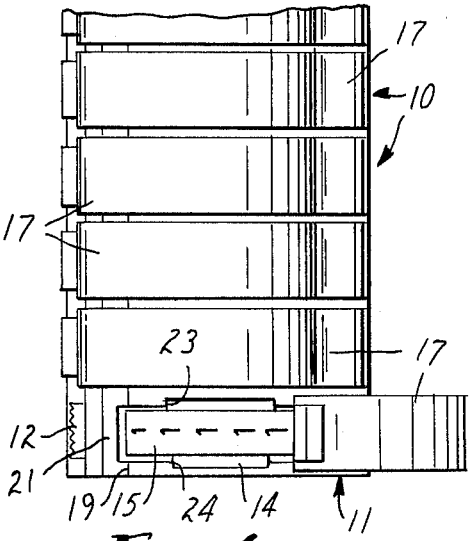
FIG. 6 is a top view of the dispenser of FIG. 1 with one door open.

The tape core 14 is supported for rotation within the housing 11 coaxially therewith. The tape core 14 is cylindrical and the housing is formed with opposing channels 23 and 24 on the interior of its end walls, the channels having semi-circular closed ends within the housing 11 to support the ends of the tape core for rotation and opening at the periphery of the housing in the area covered by the arcuate door 17 to receive and guide the ends of the core 14. A retention projection 25 is formed to project from the edge of each of the channels 23 and 24 into the channels such that the ends of the tape core can be forced past the projections 25 as the tape core is moved along the channels 23 and 24 to the closed ends of the channels, the projections 25 then retaining the tape core. One of the channels 24 and the corresponding end of the tape core 14 are narrower than the other channel 23 and its corresponding tape core end to assure proper orientation of the tape core when it is placed in the channels such that the pressure sensitive adhesive tape 15 is wound on the core in the direction that permits the non-adhesive side of its free end to fold over and contact the tape fold back area 21 of the housing 11 while the adhesive side thereof contacts and adheres to the underside of the portion of the arcuate door 17 overlying the fold back area. The adhesion of the tape 15 to the arcuate door 17 and the tape pull-off force from the tape core 14 are selected such that the tape will release from the underside of the arcuate door as the arcuate door is opened beyond the tape fold back area 21. This will produce a flag of tape 15 sticking up as illustrated in FIG. 5 so that the user may grasp the free end of the tape, pull out the desired amount and cut it against the cut-off blade 12.

Each tape dispenser 10 has an opening 27 in the peripheral wall of the housing 11 at a position generally opposite the open ends of the channels 23 and 24 to permit an object, such as the eraser end of a lead pencil, to be inserted to exert force against the tape core 14 to move it past the retention projections 25 and out of the housing after the tape 15 has been removed from the core 14. The empty core can then be replaced with a full roll of tape. In the illustrated embodiment the multiple tape dispenser includes ten tape dispensers 10. Each strip of tape 15 is printed on its non-adhesive surface with a number which is repeated down its length and the tapes are differently numbered from 0 through 9 to provide all ten of the digits necessary for wire marking. The numbers on the tapes 15 are visible through the openings 27 in the peripheral walls of the housings 11 so that the user can easily select the properly numbered tape.

The multiple dispenser is made ready for use by placing a full roll of tape 15 in each of the dispensers 10, and, with respect to each dispenser, pulling the free end of the tape out of the dispenser and then closing the arcuate door 17 to cause the tape 15 to fold back over the tape fold back area 21 and adhere to the underside of the door. Any excess tape extending out of a dispenser may be cut off against its blade 12.

Figure 3:
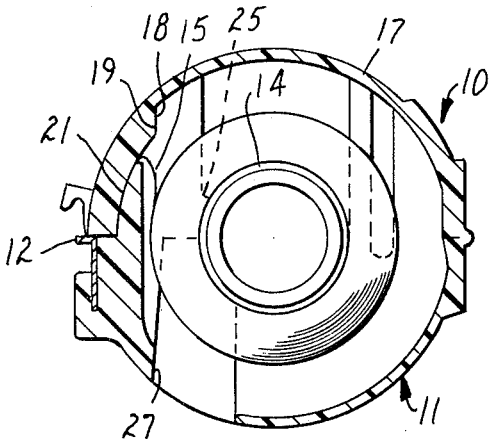
FIG. 3 is a cross sectional view taken generally along line 3—3 of FIG. 1.
Figure 4:
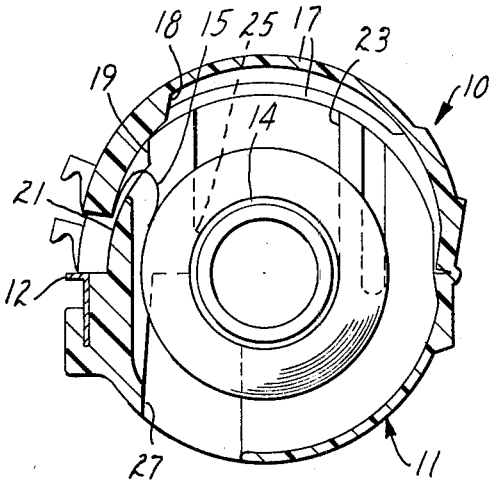
FIG. 4 is a view similar to that of FIG. 3 with the arcuate hinged door partially open.

When it is desired to use one of the tapes 15 the arcuate door 17 is opened causing the free end of the tape adhering to the back side of the door to lift from the tape fold back area 21 with the door. As the door 17 is raised the force required to pull tape from the core 14 is greater than the force required to peel the tape from the back side of the door and therefore the tape begins to peel away from the back side of the door. When the door moves past the tape fold back area 21 the free end of the tape 15 is fully stripped from the door and stands up to form a flag. The free end may then be pinched between the fingers of the user and pulled out to the desired length and severed against the blade 12 or the door 17 may be closed before severing. In either case when the door is closed the dispenser 10 returns to the position illustrated in FIG. 3 with the free end of the tape 15 is folded back over the tape fold back area 21.

In one specific embodiment, the illustrated multiple tape dispenser was constructed with a diameter of about 32 millimeters and a length of about 130 millimeters. Each housing 11 was molded of a copolymer polypropylene sold by Amoco as 6014 resin. It is believed that nearly any copolymer polypropylene will be useful and Shell 7521 resin is one other such resin that has been found acceptable. Each tape core 14 was made of a general purpose polystyrene with an outside diameter on its large end of 13 millimeters and 11 millimeters on its small end. Each tape 15 is 2.4 meters long and 5.5 millimeters wide consisting of an epoxy film backing approximately 0.13 millimeter thick with a solvent based acrylate adhesive coated 837 milligrams per 200 square centimeters, this tape being available from the Industrial Electrical Products Division of the 3M Company as No. 20 tape.

The rotational friction between the tape core 14 and the housing 11 and the adhesive force of the tape to itself on the core required about 0.5 kilogram of force to pull the tape from the core. This is a small enough force to make it easy for the user to pull the tape from the core and yet it is adequate for the user to tear the tape off against the cut-off blade 12 without applying further hold back force to the tape on the core. The peel force required to peel the free end of the tape 15 from the arcuate door 17 was about 0.1 to 0.2 kilogram. This will vary somewhat depending upon how hard the door is forced against the adhesive surface of the tape but it should always be adequate to assure that the tape will flag up with the door when the door is opened. At the same time it is desirable to have the normal peel adhesion to be less than about one half of the force required to pull the tape off the core to assure that the tape will peel from the door.

I claim:

1. A tape dispenser comprising:

a generally cylindrical, hollow plastic housing including an arcuate door hinged across the width of said housing and in its closed position forming a part of the circumferential edge wall of said housing, said housing having an arcuate tape fold back area extending from the free end of said arcuate door in its closed position parallel to and immediately beneath a portion of said arcuate door, a tape cut-off blade across the width of said housing adjacent the free end of said arcuate door in its closed position, a tape core supported for rotation within said housing, and a strip of pressure sensitive adhesive tape wound on said tape core, said tape being wound on said core such that when said arcuate door is closed the non-adhesive side of the free end thereof will fold over and contact said fold back area of said housing while the adhesive side thereof contacts and adheres to the underside of the portion of said arcuate door overlying said fold back area, the adhesion of said tape to said arcuate door and the tape pull-off force from said tape core being selected such that said tape will peel from the underside of said arcuate door as said arcuate door is opened beyond said tape fold back area.

2. The tape dispenser of claim 1 including shoulders at the edges of said arcuate door near the free end thereof and complementary recesses in the end walls of said housing for latching said door in its closed position.

3. The tape dispenser of claim 2 wherein said door is molded with a radius of curvature less than that of the complementary portions of said end walls of said housing to force the radius of curvature of said door to increase as it is closed and then to decrease slightly as said shoulders pass into said complementary recesses thereby to create a resilient tension in said door to hold it closed.

4. The tape dispenser of claim 1 wherein said tape core is cylindrical and said housing is formed with opposing channels on the interior of its end walls; said channels having semi-circular closed ends within said housing to support the ends of said tape core for rotation of said tape core and opening at the periphery of said housing in the area covered by said arcuate door when closed to receive and guide the ends of said core, and a retention projection is formed to project from the edge of one of said channels into said one channel such that the corresponding end of said tape core can be forced past said projection as said tape core is moved along said channels to the closed ends of said channels, said projection then retaining said tape core.

5. The tape dispenser of claim 4 wherein there is a retention projection projecting into each of said channels.

6. The tape dispenser of claim 4 wherein one of said channels and one of said tape core are narrower than the other channel and tape core end to assure proper orientation of said tape core when it is placed in said channels.

7. The tape dispenser of claim 4 wherein on opening is provided in the peripheral wall of said housing at a position generally opposite the open ends of said channels to permit an object to be inserted to exert force against a tape core to move it past said retention projection and out of said housing.

8. A multiple tape dispenser comprising a plurality of similar tape dispensers coaxially secured together and similarly oriented on said axis, each said tape dispenser comprising:

a generally cylindrical, hollow plastic housing including an arcuate door hinged across the width of said housing and in its closed position forming a part of the circumferential edge wall of said housing, said housing having an arcuate tape fold back area extending from the free end of said arcuate door in its closed position parallel to and immediately beneath a portion of said arcuate door, a tape cut-off blade across the width of said housing adjacent the free end of said arcuate door in its closed position, a tape core supported for rotation within said housing, and a strip of pressure sensitive adhesive tape wound on said tape core, said tape being wound on said core such that when said arcuate door is closed the non-adhesive side of the free end thereof will fold over and contact said fold back area of said housing while the adhesive side thereof contacts and adheres to the underside of the portion of said arcuate door overlying said fold back area, the adhesion of said tape to said arcuate door and the tape pull-off force from said tape core being selected such that said tape will peel from the underside of said arcuate door as said arcuate door is opened beyond said tape fold back area.

9. The multiple tape dispenser of claim 8 wherein each said tape dispenser includes shoulders at the edges of said arcuate door near the free end thereof and complementary recesses in the end walls of said housing for latching said door in its closed position.

10. The multiple tape dispenser of claim 9 wherein each said door is molded with a radius of curvature less than that of the complementary portions of said end walls of said housing to force the radius of curvature of said door to increase as it is closed and then to decrease slightly as said shoulders pass into said complementary recesses thereby to create a resilient tension in said door to hold it closed.

11. The multiple tape dispenser of claim 8 wherein in each said tape dispenser said tape core is cylindrical and said housing is formed with opposing channels on the interior of its end walls; said channels having semi-circular closed ends within said housing to support the ends of said tape core for rotation of said tape core and opening at the periphery of said housing in the area covered by said arcuate door when closed to receive and guide the ends of said core, and a retention projection is formed to project from the edge of one of said channels into said one channel such that the corresponding end of said tape core can be forced past said projection as said tape core is moved along said channels to the closed ends of said channels, said projection then retaining said tape core.

12. The multiple tape dispenser of claim 11 wherein there is a retention projection projecting into each of said channels.

13. The multiple tape dispenser of claim 11 wherein in each said tape dispenser one of said channels and one end of said tape core are narrower than the other channel and tape core and to assure proper orientation of said tape core when it is placed in said channels.

14. The multiple tape dispenser of claim 11 wherein in each said tape dispenser an opening is provided in the peripheral wall of said housing at a position generally opposite the open ends of said channels to permit an object to be inserted to exert force against a tape core to move it past said retention projection and out of said housing.

15. The multiple tape dispenser of claim 14 wherein there are ten of said tape dispensers, each said strip of tape is printed on its non-adhesive surface with a number which is repeated down its length and the tapes are differently numbered from 0 through 9, and said numbers are visible through said openings in the peripheral walls of said housings.

* * * * *